United States Patent [19]

Tabor

[11] 4,362,213

[45] Dec. 7, 1982

[54] METHOD OF IN SITU OIL EXTRACTION USING HOT SOLVENT VAPOR INJECTION

[75] Inventor: Paul R. Tabor, Mercerville, N.J.

[73] Assignee: Hydrocarbon Research, Inc., Lawrenceville, N.J.

[21] Appl. No.: 208,214

[22] Filed: Nov. 19, 1980

Related U.S. Application Data

[63] Continuation of Ser. No. 974,630, Dec. 29, 1978, abandoned.

[51] Int. Cl.[3] ..... E21B 43/24; E21B 43/40

[52] U.S. Cl. ..... 166/267; 166/303; 166/306

[58] Field of Search ..... 166/266, 267, 303, 304, 166/306

[56] References Cited

U.S. PATENT DOCUMENTS

| | | | |
|---|---|---|---|
| 2,265,923 | 12/1941 | Normand | 166/307 X |
| 2,342,165 | 2/1944 | Plummer | 166/266 X |
| 2,412,765 | 12/1946 | Buddrus et al. | 166/267 X |
| 2,969,226 | 1/1961 | Huntington | 166/266 X |
| 3,126,951 | 3/1964 | Santourian | 166/269 |
| 3,126,961 | 3/1964 | Graig, Jr. et al. | 166/306 X |
| 3,351,132 | 11/1967 | Dougan et al. | 166/266 |
| 3,358,756 | 12/1967 | Vogel | 166/266 |
| 3,515,213 | 6/1970 | Prats | 166/303 X |
| 3,695,354 | 10/1972 | Dilgren et al. | 166/266 X |
| 3,881,550 | 5/1975 | Barry | 166/303 X |
| 4,022,277 | 5/1977 | Routson | 166/303 X |
| 4,034,812 | 7/1977 | Widmyer | 166/303 |

*Primary Examiner*—James A. Leppink
*Assistant Examiner*—George A. Suchfield
*Attorney, Agent, or Firm*—Vincent A. Mallare; Fred A. Wilson

[57] ABSTRACT

Heavy oil or bitumen is extracted and removed from underground oil bearing formations having low permeability such as tar sands by injection of hot hydrocarbon solvent vapor into a single well hole at a pressure not substantially exceeding the pressure in the formation to effectively heat and extract the bitumen. The hot solvent vapor is passed downwardly through an annular passage of concentric piping place in the well bore and is injected out through upper performations in the casing and into the formation. The hot solvent vapor condenses in the formation and drains along with recovered oil through lower perforations back into the bottom end of the inner pipe, from which the product oil and solvent mixture is pumped to above ground. The solvent is partially reclaimed from the oil product by distillation means and the solvent friction is reheated and reinjected into the well bore for further use.

The solvent used should be matched to the characteristics of the bitumen in the tar sands formation for most effective recovery of bitumen, and contains substantially aromatic compounds. As more bitumen is dissolved and removed from the formation, the injection and drainage perforations in the casing are spread further apart vertically so as to cause the solvent to penetrate the formation more effectively and dissolve bitumen further away from the bore hole.

5 Claims, 4 Drawing Figures

METHOD OF IN SITU OIL EXTRACTION USING HOT SOLVENT VAPOR INJECTION

This is a continuation of application Ser. No. 974,630, filed Dec. 29, 1978, now abandoned.

BACKGROUND OF THE INVENTION

1. Field of the Invention

This invention pertains to the improved recovery of heavy oil and tars from underground formations containing same by the injection of hot hydrocarbon vapors to heat the formation and extract the oil. It pertains more particularly to the effective recovery of such oils from relatively impermeable formations such as tar sand by hot hydrocarbon solvent vapor injection into the formation to extract and recover the oil using a single well hole.

2. Description of Prior Art

The in situ recovery of oil from underground formations is well known and there are several prior art patents in the area of oil recovery by injecting either aqueous or hydrocarbon solvent vapors into oil formations. Some of these patents use vaporized solvents such as benzene, toluene, carbon disulfide, kerosene, and a variety of other aromatic solvents and mixtures of solvents. These known processes usually depend upon the use of two or more boreholes, one borehole used for injection of the heated solvent vapor into the formation and one or more boreholes used for recovering the oil/solvent liquids. For example, U.S. Pat. No. 3,608,638 to Terwilliger shows injecting hot pressurized vapor into one well at the top of an oil bearing formation to promote oil production from another adjacent well. But these prior art systems require that the oil bearing formations have sufficient permeability to allow lateral fluid communication between the injection and production wells. However, in many oil bearing formations, such as tar sands, the original permeability is too low to permit using a two well production arrangement.

Oil recovery methods using single well systems have been used for producing oil from oil shale formations, which have been previously fractured by explosive means to make them permeable, followed by injecting hot gases and vapors into the formation. For example, U.S. Pat. No. 3,515,213 to Prats and U.S. Pat. No. 3,695,354 to Dilgren et al disclose shale oil recovery from such permeable shale formations by injecting heated fluids to stimulate oil recovery from the same well. However, the prior art apparently does not disclose recovering heavy oils and/or tars from essentially impermeable formations by injecting hot hydrocarbon solvent vapor into an upper portion of the formation and recovering oil along with condensed solvent from a lower portion of the formation using a single well hole. Thus, the present invention is directed to the effective recovery of heavy oils and tars by hot vapor injection using single wells, without regard to or depending on lateral fluid communication between adjacent wells, by directing the hot vapor to desired portions of the formation and recovering the liquids from a lower portion of the well.

SUMMARY OF THE INVENTION

This invention comprises an improved method for in situ recovery of heavy oils and tars from underground formations, and particularly for the effective recovery of bitumen from tar sands formations having low initial permeability using hot hydrocarbon solvent vapor injected into a single well hole to heat and extract the oil. The solvent is heated in a boiler and/or distillation unit at a pressure only slightly exceeding that in the oil formation. The heated vapor is injected into the well hole through a rigid casing and exits the casing through upper perforations therein and passes into the formation. The vapor is prevented from continuing further down the casing by a packer set in the annular space between the casing and an inner pipe string. The hot solvent vapor condenses in the oil bearing formation, heats it and also extracts the oil or tar (bitumen) from the formation. Extracted oil, along with condensed solvent, moves generally downwardly through the formation and reenters the well casing through lower perforations. The collected liquid is pumped to above ground level through the inner pipe.

Above ground, the solvent fraction is reclaimed by evaporation in a separator and/or distillation unit. The reclaimed solvent is usually recycled to the boiler for reheating and reinjection into the well. The remaining heavy oil from the separator or distillation unit is then ready for further treatment either at the site or for shipment to a refinery.

The hydrocarbon solvent used should be vaporizable at temperatures which will not cause appreciable cracking of either the solvent or the oil in the formation and must be miscible in the oil. The solvent vapor injected into the well should be as hot as possible, without causing significant cracking of the solvent as it passes downward through the casing, so as to enter the formation in substantially vapor form. Preferred solvents or solvent mixtures are aromatic compounds or hydrocarbon mixtures containing substantial amounts of aromatic materials. Examples of such hydrocarbon solvents are benzene, toluene, xylenes, naphtha or other aromatic solvents having boiling range of about 200°–400° F. The vapor temperature at the wellhead should be at least about 300° F., and preferably 500°–700° F. Since the oil composition to be recovered is variable from one field or formation to another, the properties of the solvent or solvent mixture used should be matched to the characteristics of the oil formation to provide for the most effective recovery of oils therefrom.

In this process, the solvent vapor is injected at pressure not appreciably exceeding the underground formation static pressure, and preferably is at pressure only about 20–100 psig greater than the formation pressure. If the solvent vapor injection pressure appreciably exceeds the formation static pressure, severe solvent vapor leakage and/or rupture of the overburden soil layer may occur, particularly if the oil bearing formation is located near the earth surface. Furthermore, high operating vapor pressures cause the solvent, which is condensed in the formation to migrate and dissolve in the heavy oil bitumen farther away from the well hole. Although some migration of solvent away from the injection port is desired, sufficient solvent must be available to cause the extracted oil or bitumen to flow to the well. At high operating vapor pressures, the bitumen absorbs more solvent but does not become fluid enough to flow to the well bore, which contributes to solvent loss in the formation and thus is undesirable. Thus, the forced migration of solvent away from the well bore is undesirable, as reclaiming of the solvent is thereby made more difficult.

As the hot solvent vapor contacts the oil formation or tar sand matrix, the vapor condenses and warms the formation. At the same time, the condensed solvent dissolves and dilutes the oil. The diluted bitumen flows through the lower perforations back into a sump at the bottom of the well casing, from which it is pumped to the surface for solvent separation and reclaim. As the solvent continues to leach out the oil or bitumen, the formation warms and allows the oil and condensed solvent liquid to flow more easily to a lower portion of the well. It is essential that a liquid layer be maintained in the formation between the vapor injection and oil drainage points of the casing as a means of controlling vapor flow and preventing its breakthrough to the drainage points. As the bitumen is removed from the formation the permeability is increased, thereby permitting oil recovery from distances farther from the vapor injection point.

Such injection of hot solvent vapor per this invention eliminates the tendency to form water-oil emulsions and significantly improves the viscosity of the heavy oil produced. Also the viscosity of the recovered solvent-/bitumen mixture is usually low enough to minimize or avoid sanding problems within the casing perforations. By maintaining consistent vapor flow rates and a low viscosity of the extracted liquid, the recovered liquid does not lift and transport sand grains as easily as would a more viscous liquid such as water, to cause undesirable plugging of the casing perforations. Thus, this oil recovery process usually will not require a gravel pack placed around the lower perforations of the well casing, or screening around perforations in the inner pipe to filter out sand particles.

Use of a movable packer positioned in the annular space between the casing and inner pipe and vertically within the oil formation allows improved control over this oil extraction process. After fluid communication has been established between the vapor injection point and oil removal point outside the well casing, a fluid flow channel develops through the formation for carrying out the oil or bitumen. Once the fluid flow channel develops, preferential extraction of bitumen occurs along that channel. To prevent the hot solvent vapor from flowing directly through this channel, the casing packer is preferably repositioned to vertically separate further the vapor injection level and oil removal level in the casing. This can be accomplished preferably by initially locating the fluid injection and removal points in the lower portion of the tar sands formation. Then as oil recovery proceeds, the point of vapor injection is progressively moved upward in the casing, usually by adding an additional packer above the existing or first one, and thereby causing vapor injection to occur at a point higher on the casing. Furthermore, if the packer is not made movable, an increase in the vapor injection pressure or a more rapid oil pumping rate could result in undesirable vapor breakthrough between the injection and recovery points external of the casing. Again, it is essential that a liquid layer be maintained between the vapor injection and oil drainage points as a means of controlling solvent vapor flow and preventing such vapor breakthrough.

By controlling location of the injection point for the hot solvent vapor, a volume of tar sand can be effectively stripped of bitumen to form a generally inverted cone shape having its apex near the bottom of the wellbore. When the oil content of the produced liquid decreases to an unfavorable level, vapor injection is stopped. After a period of time, the drainage liquid can be pumped from the well. The formation will produce these drainage liquids for some period of time after vapor injection has ceased, due to a combination of increased formation temperature and gravity flow of liquids. Depending upon operating conditions, the formation and bitumen characteristics, and the solvent(s) used, oil recoveries of up to about 90 percent can be achieved.

The light fractions of the recovered oil provide the most convenient source for the hydrocarbon solvent vapors needed for injection and they can be conveniently obtained in the field by partial distillation of the recovered oil. In some oil formations it may be advantageous to improve the solvent power of the injected hydrocarbon vapor by adding an externally produced aromatic hydrocarbon material, such as benzene or toluene. Portable skid mounted distillation equipment is provided at the well site to accomplish this oil fractionation and blending in the field.

As recovery of oil continues from adjacent individual wells being produced, the recovered areas will ultimatedly intersect and fluid communication between adjacent wells will be established. This condition is not an essential feature of the present invention and serves only to provide a further stage for the recovery of oil and injected solvent from the formation.

At completion of the oil recovery process from a particular well or wells, some quantity of condensed solvent will remain in the formation. A substantial part of this solvent can be reclaimed by injecting suitable hot fluids which are inexpensive and readily available. One procedure is to run a normal steam drive on the borehole, so that the steam will further warm the formation and cause an increased flow of oil and solvent into the well. However, such use of steam also fills the pore spaces with water and may inhibit flow of the remaining solvent to the well bore. Also, steam soaking may cause some flow restriction due to sanding problems when liquid is pumped from the well. As another alternative, two adjacent wells both of which have been previously operated as single well systems, can provide a path of communication and allow the injection of steam into one well and recovery of oil and solvent from an adjacent well. Depending upon formation characteristics, the solvents used and operating conditions, the reclaiming of solvent and its recycle for reinjection into the formation can approach 90 percent efficiency.

DESCRIPTION OF PREFERRED EMBODIMENTS

Figure 1:
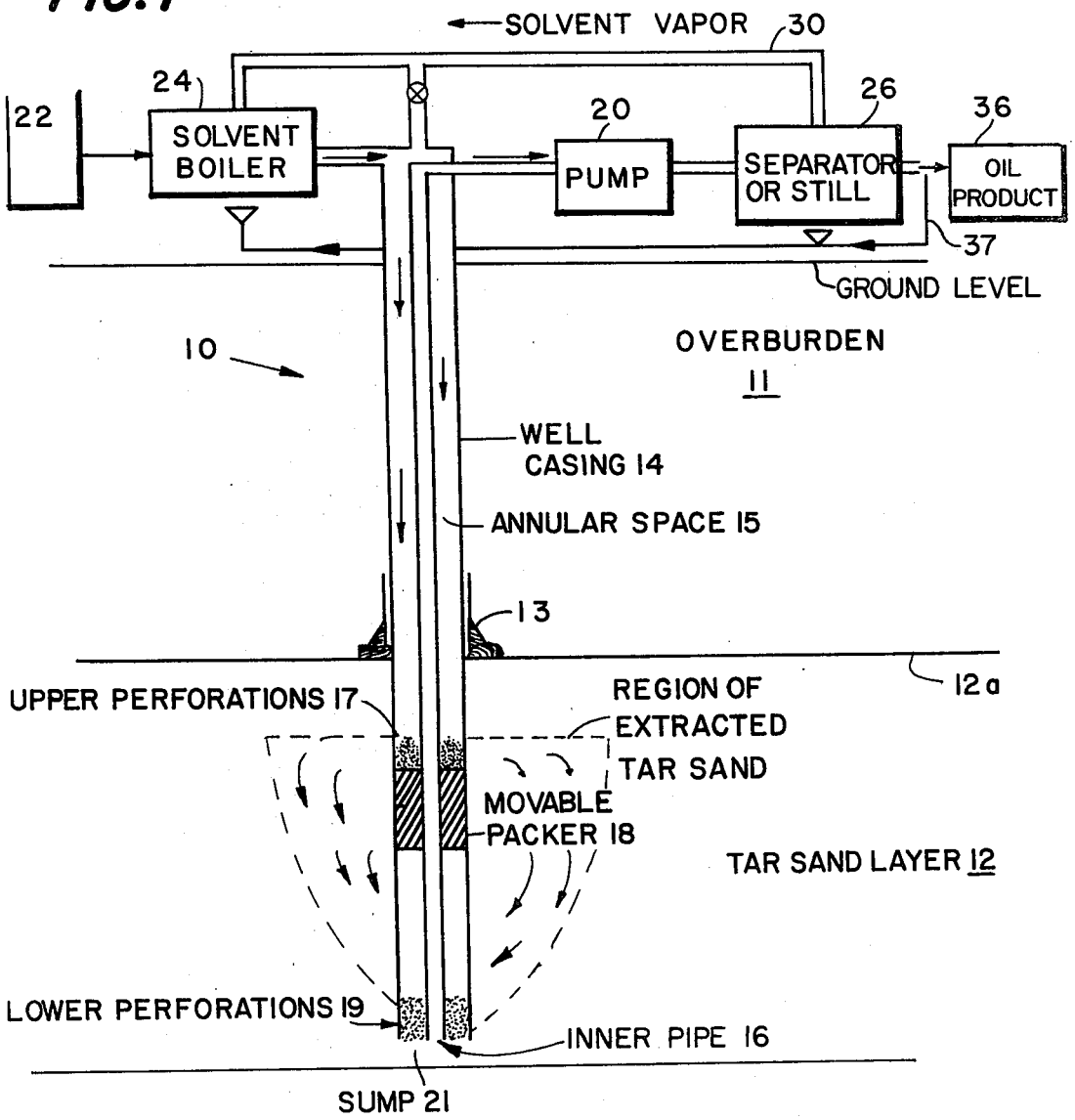
FIG. 1 shows a typical oil well and hydrocarbon vapor generating equipment for hot vapor injection into and oil recovery from an oil or tar bearing formation.

As illustrated by FIG. 1, a borehole generally indicated at 10 is drilled through overburden 11 into an oil bearing formation 12, which may preferably be a tar sands formation such as the Athabasca tar sands located in Alberta, Canada, or the Utah tar sands of the United States. Casing 14 is inserted into borehole 10 and cemented in place within the overburden at 13. Inner tubing string 16 is installed within the casing 14 and retained by packer 18 installed therebetween and within the formation 12. Upper perforations 17 are provided in the casing above the packer for injecting hot hydrocarbon vapor into the formation 12, and lower perforations 19 are provided in the casing below the packer for return of oil and solvent. Pump 20 is provided, preferably at the lower end of tubing 16, for recovery of oil drained from the formation into sump 21 by pumping the oil to above ground in accordance with established practice in the industry.

A hydrocarbon solvent liquid at 22 is provided to a heated boiler 24 and initially vaporized at a sufficient pressure to force the hydrocarbon vapor through annular space 15 and upper perforations 17 into the oil bearing formation 12. Typically, heavy oil and tar deposits are found at depths less than about 1000 feet, requiring a vapor pressure of approximately 500 psig or less. In most cases it is desirable to superheat the vapor to overcome heat losses which occur in piping the vapor to the individual well and down to the formation, and to permit condensation of the hydrocarbon vapor in the oil bearing formation. This can be preferably accomplished with a superheater passage incorporated into the boiler 24.

The hot hydrocarbon vapor passes down annular space 15 and through upper perforations 17 into the oil bearing formation 12. In the formation the hot hydrocarbon vapor cools, condenses and reacts with the heavy oils and/or tars entrapped therein to heat and solubilize them and thereby reduce their viscosity. The small annular space existing around the outside of casing 14 provides an initial passageway for the hot solvent vapor to contact the formation. The resulting reduced viscosity oil flows into sump 21 at the bottom of inner tubing 16. From this sump the oil is lifted to the surface by pump 20 in accordance with well established practice in the industry.

Other type lift pumps, such as a down hole type electric pump, could also be used. A pump located at the bottom of the well is desirable for several reasons. It reduces the bottom hole pressure and thus promotes flow of oil to the sump 21 and tubing 16. Also, as the bottom pressure is reduced, the solvent vaporizes at a lower temperature and can more easily penetrate the formation, and therefore lowers the temperature to which the formation 12 must be heated to recover the oil. Finally, the pump raises the pressure of the liquid mixture being pumped up through production tubing 16, thus preventing it from being boiled by the downward flowing hot vapor steam and extracting heat therefrom.

The recovered oil and condensed hydrocarbon liquid is passed to separation and/or distillation unit 26, where it is heated and some solvent vapor recovered as overhead stream 30 for reinjection as a pressurization vapor into the well casing 14. The recovered bottoms oil liquid product is withdrawn from the distillation step at 36.

After continuous operation and recovery of oil is achieved, a substantial quantity of solvent vapor may be generated from the oil distillation step 26. In such case, use of an external hydrocarbon liquid at 22 for start-up purposes may be reduced or terminated as desired. Alternatively if desired, an external aromatic hydrocarbon liquid having improved solvent power such as benzene or toluene may be added at 22 as needed to improve the extraction and recovery of the heavy oils from formation 12.

Fuel for the boiler 24 and still 26 may be supplied either by combustion of an externally supplied fuel oil or gas, or by combustion of a portion 37 of the recovered oil product 36. Combustion of the recovered oil product would be the preferred option, unless the cost of stack gas scrubbing and environmental controls outweighed the fuel cost advantages of burning the crude oil.

Figure 2:
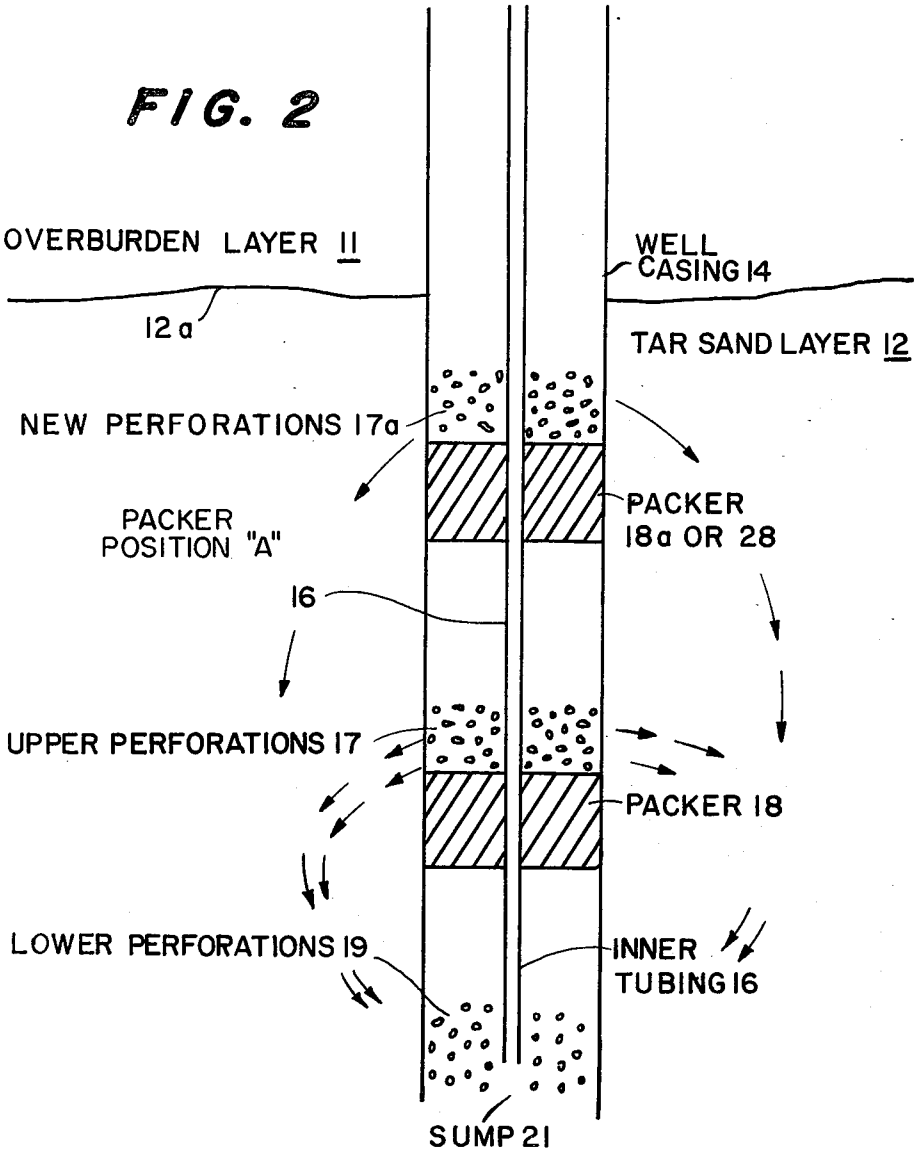
FIG. 2 shows a typical oil well and oil bearing formation using a movable type packer and selected vapor injection in accordance with a preferred embodiment of the invention.

A preferred alternative for oil recovery utilizing a movable packer concept is shown in FIG. 2. The well casing 14 is initially perforated at 17 and 19 and packer 18 is positioned intermediate the perforations as shown. Pressurized hot solvent vapor enters the tar sand formation 12 through the upper perforations at 17. The resulting solvent/oil mixture extracted from the formation reenters the casing 14 through the lower perforations at 19 and is pumped to above ground through inner pipe 16. For effective recovery of oil from the entire formation, the lower perforations 19 should usually be located as close as is reliably possible to the effective lower boundary of the formation, such as at least about 3 feet and preferably 5 to 10 feet above the lower boundary of the formation. These distances can be varied to match the physical positioning of the packer and casing perforations.

After fluid communication is established through the formation 12 between perforations 17 and 19, hot solvent vapor injection is continued until oil recovery begins to decline from the particular portion of the formation being produced. Packer 18 is then moved upward in the casing 14 to the point indicated "A" after the casing is reperforated at 17*a*. Hot solvent vapor injection is resumed and continues as previously described, with the vapor being injected into a new upper portion of the oil bearing formation 12. The packer 18 is similarly moved periodically upward through the well casing 14 to new position 18*a* and the casing in reperforated above the packer as needed to allow the solvent vapor injection to occur progressively nearer the upper boundary of the tar sand formation. Removal of the recovered solvent/oil mixture is accomplished by pumping the liquid up through the inner tubing 16 as previously described.

An alternative procedure to moving packer 18 upward in well casing 14 is to perforate the casing as indicated at 17*a*, position a new packer 28 at position "A", and leave the original packer 18 set within the casing 14. In this manner, a series of new packers can be positioned at higher levels in the casing 14. As each new packer is positioned after the casing is further perforated at higher levels, the hot solvent vapor contacts a new and larger vertical portion of the tar sand formation 12.

As illustrated in FIG. 2, the original path of fluid flow is from the upper perforations at 17 to the lower perforations at 19. When new packer 28 is installed, the new fluid path is from perforation 17*a* to perforation 19. Ultimately, hot solvent vapor will enter the tar sand formation at a point near the upper boundary 12*a* of the formation, while the resulting oil/solvent liquid mixture will reenter the casing at the lower perforations 19 near the lower boundary of the tar sand formation 12. Using this preferred procedure, substantially the entire vertical thickness of the formation can be effectively exposed to the action of the hot solvent vapor for extraction and recovery of oil therefrom.

In a similar manner, the injection of hot vapor may be initiated through casing perforations and the extracted oil and solvent removed through perforations all located initially in the upper portion of an oil bearing formation. The lower or drain perforations are then progressively located further downward in the casing, so as to expose new portions of the oil formation to the injected hot vapor to heat the formation and extract the oil. Using this procedure, substantially the entire thickness of the formation can be effectively exposed to the hot solvent vapor for extraction and recovery of the oil.

While individual wells 10 are usually intended to be operated independently, a plurality of wells may be served by a single hydrocarbon solvent vapor supply and distillation unit. The boiler and distillation units will preferably be direct fired pressure vessels mounted on a skid and capable of being moved from well site to well site as oil production from the individual groups of preferably three wells become exhausted. The wells would be preferably arranged as an equilateral triangle pattern, with spacing of more than about 100 feet but less than 600 feet on a side.

Using the hot vapor injection method of this invention, the single wells should be produced until the stripped sand areas from adjacent wells intersect, to eliminate as much as possible of the interface between heavy oil and clean sand and to promote maximum reclaim and reuse of solvent. Once linkage has been achieved between adjacent wells, various secondary recovery techniques may be used to recover additional oil and solvent from the formation.

The operation and benefits of this invention will be further illustrated by reference to the following examples and experiments, which should not be construed as limiting the scope of this invention.

EXAMPLE 1

Figure 3:
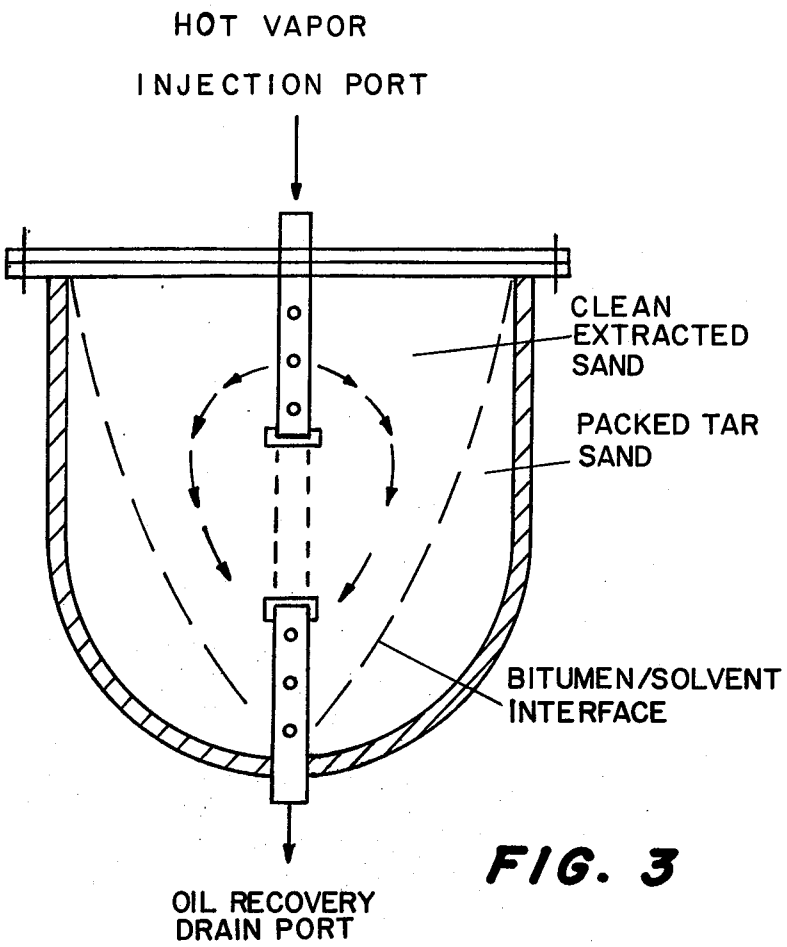
FIG. 3 is a diagram of an experimental recovery vessel showing details of the perforated injection and drain ports in simulated tar sand formation.

To achieve realistic conditions for experiments on oil recovery from heavy oil formations such as tar sands deposits having low permeability, it is essential to achieve a thoroughly compacted and nearly impermeable structure closely representative of the original tar sands material in place underground. To provide such a simulated tar sands formation, Utah tar sand, having characteristics as described in Table 1, was hot packed into a pressurizable vessel 10 inch diameter and 10 inch deep and allowed to cool; thereby closely simulating the low permeability of the sand in its original undisturbed condition. The pressure vessel was provided with a ¼" standard pipe nipple (0.360 in. inside diameter) injection port centrally located in the top and a ¼" standard pipe perforated drain port centrally located in the bottom as shown in FIG. 3. Using this configuration, the injected hot vapor was forced to pass outwardly through the sand formation before reaching the drain port. Approximately 22,000 grams of the tar sand material was packed into the vessel at a temperature of about 250° F. and allowed to cool to ambient temperature. A rod was centrally located in the vessel prior to packing of the sand, then removed to provide a cored ⅝" diameter hole vertically through the center of the sand to simulate a well bore.

TABLE 1

CHARACTERISTICS OF UTAH TAR SAND
Formation Location: Vernal County, Utah

| Tar Sand As-Received | | |
|---|---|---|
| Density | 2.164 grams/cc | |
| Water | 2.40 W % | |
| Oil | 11.6 W % - Toluene Soluble | |
| Specific Heat | | |
| | Temperature | |
| Calories/Gram | °C. | °F. |
| 0.377 | 100 | 212 |
| 0.387 | 120 | 248 |
| 0.397 | 140 | 284 |
| 0.405 | 160 | 320 |
| 0.414 | 180 | 356 |
| 0.427 | 200 | 392 |
| Extracted Oil (Toluene Soluble, Toluene Free) | | |
| °API Gravity | 8.6 | |
| Sulfur, W % | 0.35 | |
| Viscosity | | |
| Centipoise | | °F. |
| 1487 | | 175 |
| 874 | | 190 |
| 414 | | 212 |
| 248 | | 230 |
| Vacuum Distillation | °F. | |
| IBP | 529 | |
| 5 ml | 651 | |
| 10 ml | 750 | |
| 20 ml | 880 | |
| 25 ml | 940 | |
| 30 ml | 975− | 32.46 W % |
| | 975+ | 65.12 W % |
| | Loss | 2.42 W % |
| Oil-Free Sand | | |
| Specific Gravity | 2.363 grams/cc | |
| Compacted Bulk Density | 1.56 grams/cc | |
| Screen Analysis | | |
| Mesh | W % | |
| +50 | 26.67 | |
| 50-70 | 30.92 | |
| 70-100 | 18.43 | |
| 100-140 | 7.96 | |
| 140-200 | 4.83 | |
| 200-325 | 5.24 | |
| −325 | 5.96 | |

The vessel was closed with the injection pipe being inserted into the cored hole in the tar sand. The resulting simulated tar sand formation was contacted with toluene vapor introduced through the injection port at the top of the vessel at pressures up to about 50 psig and average temperatures up to about 350° F. Using a cyclic pressurization mode during a 4.5 hour test, 96 grams of oil were recovered from the sand or about 4% of the oil present. In a continuous operation mode, 158 grams of oil were recovered in four hours or about 6.5% of that present, showing still better performance for the continuous vapor injection mode. In another test run under similar continuous injection mode conditions with vapor heated to 380° F. average temperature, 19.6 W % of the oil present was recovered. Thus, it is apparent that using increased temperatures of the hydrocarbon vapor injected provides a corresponding increase in oil recovery from the tar sand. The area of extracted oil was generally conical shaped with the apex near the drain hole, as shown in FIG. 3.

Figure 4:
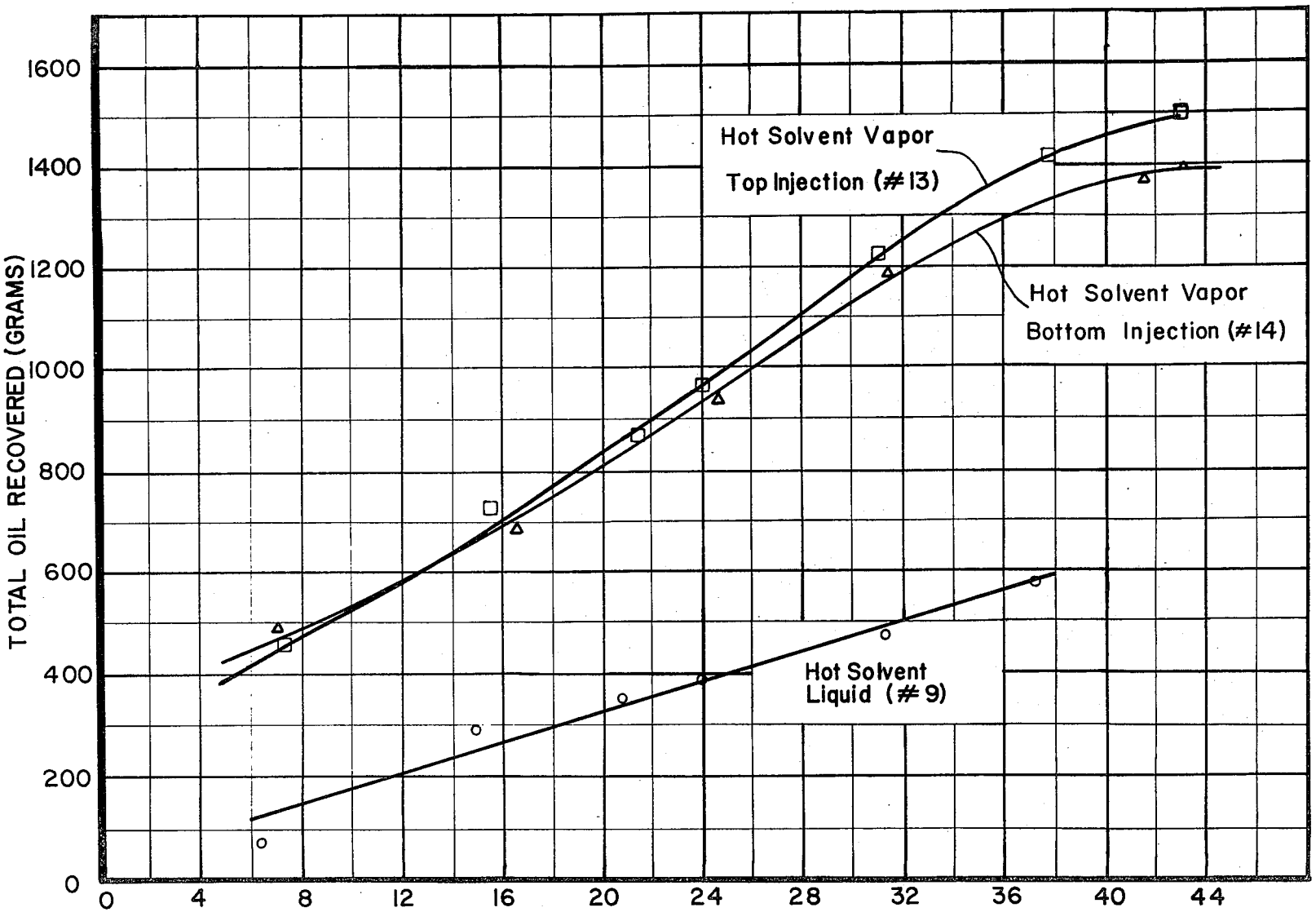
FIG. 4 is a graph showing the improved oil recovery obtained from hot hydrocarbon vapor injection into a simulated tar sands formation.

FIG. 4 shows a comparison of oil recovery obtained from Utah tar sand with continuous solvent liquid injection and with continuous hot solvent vapor injection over about 40 hours duration. It can be seen that the solvent vapor is appreciably more effective in recovering oil from the tar sand than solvent liquid, apparently due to the higher temperature and greater mobility of the vapor. Also, it was unexpectedly noted that sand plugging problems (sanding) in the drain holes from the vessel were substantially reduced with solvent vapor injection as compared to steam injection.

EXAMPLE 2

Additional experiments were conducted using Utah tar sands hot packed into the reactor vessel as per Example 1 to simulate its original condition, with the injection of hot solvent vapor being made about 3" from the top and also about 3" from the bottom of the vessel. FIG. 4 shows a comparison between injection of hot toluene solvent vapor near the top of the simulated tar sand formation and its injection nearer the bottom, without a cored intervening passageway. It can be seen that the injection of hot vapor nearer the top of the simulated formation is more effective for recovery of bitumen, and is the preferred injection mode. Specifically, in Run No. 13 with top injection of toluene vapor, a total of 61% of the oil originally in place was recovered during 43 hours of operation. In Run No. 14 with bottom injection of toluene vapor, only 57% of the oil in place was recovered in 43 hours of operation.

EXAMPLE 3

Samples from the Athabasca tar sand deposit in Canada as described in Table 2 and from a California heavy oil sand deposit were also tested in simulated formations using the new recovery method by hot hydrocarbon vapor injection per Example 2. Even using the bottom injection mode for hot toluene vapor, 90.7% of the original oil in place was recovered from Athabasca tar sand, and 90.9% was recovered from the California oil sand after about 44 hours operation. In all cases, the sand in the vicinity of the bore hole was found to be stripped clean and completely free of oil. This volume of completely extracted sand increased in size as the solvent vapor injection continued with an approximately constant ratio of oil extracted to solvent vapor fed. That is to say, the diameter of the circular shaped stripped area grew approximately as the square root of vapor injection time for constant injection rates of solvent vapor.

EXAMPLE 4

Solvent reclaiming is also a critical factor in the successful application of this solvent vapor injection method for oil recovery from tar sand formations. It was found during these tests on simulated tar sand formation that aromatic hydrocarbon solvent dissolved readily in the heavy oil or tar, creating a mushy mixture of tar sands and solvent from which all the solvent does not flow to the drain hole. As a result, some solvent is retained at the interface between the clean, extracted sand area and the original unaffected tar sand. It was found desirable to operate with the highest possible rate of solvent vapor injection without causing solvent vapor breakthrough to the oil recovery point, both to maximize production from a particular well and also to minimize the thickness of the mushy sand zone and the retention of solvent in the formation. A rate of approximately 10 to 20 barrels of solvent evaporated per hour per well with standard 7" diameter casing is reasonable. At this rate, the retention of solvent will be approximately 2.2 lb. of solvent per square foot of exposed tar sand.

TABLE 2

| CHARACTERIZATION OF ATHABASCA TAR SAND | | |
|---|---|---|
| Tar Sand As-Received | | |
| Density, gm/cc | 1.93 | |
| Water, W % | 1.15 | |
| Oil (benzene-soluble), W % | 15.2 | |
| Sulfur, W % | 4.98 | |
| Sand, W % | 83.65 | |
| Extracted Oil (Benzene-Soluble) | | |
| Gravity, °API | 8.9 | |
| Viscosity, centipoise | | |
| @ 175° F. | 315 | |
| @ 190° F. | 192 | |
| @ 212° F. | 110 | |
| @ 230° F. | 70 | |
| Vacuum Distillation | | |
| IBP | 545° F. | |
| 5 ml | 655° F. | |
| 10 ml | 712° F. | |
| 20 ml | 765° F. | |
| 30 ml | 810° F. | |
| 40 ml | 875° F. | |
| 50 ml | 940° F. | |
| 56 ml | 975° F.− | 40.0 W % |
| | 975° F.+ | 57.4 W % |
| | Loss, | 2.6 W % |
| Oil-Free Sand | | |
| Specific Gravity, g/cc | 2.59 | |
| Compacted Bulk Density, g/cc | 1.59 | |
| Screen Analysis, W % | | |
| Mesh | | |
| +50 | 23.2 | |
| 50–70 | 49.1 | |
| 70–100 | 18.5 | |
| 100–140 | 4.4 | |
| 140–200 | 1.8 | |
| 200–325 | 1.7 | |
| −325 | 1.4 | |

Following the solvent injection and recovery of oil, steam was injected cyclically to heat the sand and recover significant quantities of additional oil and solvent.

Although this invention has been described for the recovery of oil from tar sand deposits, it is also applicable to the secondary recovery of heavy oils remaining in previously pumped oil fields. While the above description discloses preferred embodiments of my invention, it is recognized that other modifications will be apparent to those skilled in the art. It is understood, therefore, that my invention is not limited only to those specific methods, steps or combinations of same described, but covers all equivalent methods and steps that may fall within the scope of the appended claims.

I claim:

1. A method for recovering heavy hydrocarbons from an underground oil bearing formation, comprising the steps of:

(a) providing a well hole through overburden and extending into the oil formation, and inserting a tubular casing into the hole;

(b) perforating the casing at upper and lower locations vertically within the formation;

(c) providing an inner pipe within the casing and positioning a first packer in the annulus between the casing and inner pipe at an intermediate level within the formation, so that the casing perforations are above and below the packer;

(d) positioning a second packer above the first packer so that the vapor injection point is moved upward in the oil containing formation;

(e) injecting hot hydrocarbon solvent vapor into the annulus at pressure not more than about 100 psi greater than the formation pressure, so that the vapor passes outwardly through the upper perforations and into the formation to initially warm and extract oil from the formation;

(f) allowing the extracted oil and condensed solvent liquid to drain through perforations below the first packer into the lower end of the casing and piping, while maintaining a liquid layer in the formation between the vapor injection point and the oil drainage point to prevent vapor breakthrough to the drainage point, then pumping the recovered oil and solvent liquid mixture out through the inner pipe to above ground;

(g) reclaiming a solvent fraction from the recovered oil and solvent mixture by distillation; and (h) separately reheating the reclaimed solvent fraction and reinjecting it into the well hole to recover additional oil from the formation.

2. A method for recovering heavy hydrocarbons from an underground oil containing formation, comprising the steps of:

(a) providing a well hole through overburden and extending into the oil formation, and inserting a tubular casing into the hole;

(b) perforating the casing at upper and lower locations vertically within the formation;

(c) providing an inner pipe within the casing and positioning a packer in the annulus between the casing and inner pipe at an intermediate level within the formation, so that the casing perforations are above and below the packer;

(d) injecting hot hydrocarbon solvent vapor into the annulus at pressure not more than about 100 psi greater than the formation pressure, so that the vapor passes outwardly through the upper perforations and into the formation to warm and extract oil from the formation;

(e) allowing the extracted oil and condensed solvent liquid to drain through the perforations below the packer into the lower end of the casing and piping, then pumping the recovered oil and solvent liquid mixture out through the inner pipe to above ground;

(f) reclaiming a solvent fraction from the recovered oil and solvent mixture by distillation;

(g) using a portion of the recovered oil as fuel to fire and heat distillation step (f); and (h) reinjecting the reclaimed solvent fraction into the well hole.

3. A method for recovering heavy hydrocarbons from an underground oil bearing formation, comprising the steps of:

(a) providing a well hole through overburden and extending into the oil formation, and inserting a tubular casing into the hole;

(b) perforating the casing at upper and lower locations vertically within the formation;

(c) providing an inner pipe within the casing an positioning a packer in the annulus between the casing and inner pipe at an intermediate level within the formation, so that the casing perforations are above and below the packer;

(d) injecting hot hydrocarbon solvent vapor into the annulus at pressure not more than about 100 psi greater than the formation pressure, so that the vapor passes outwardly through the upper perforations and into the formation to warm and extract oil from the formation;

(e) allowing the extracted oil and condensed solvent liquid to drain through perforations below the packer into the lower end of the casing and piping, while maintaining a liquid layer in the formation between the vapor injection point and the oil drainage point to prevent vapor breakthrough to the drainage point, then pumping the recovered oil and solvent liquid mixture out through the inner pipe to above ground;

(f) reclaiming a solvent fraction from the recovered oil and solvent mixture by distillation;

(g) reinjecting the reclaimed solvent fraction into the well hole; and (h) positioning an additional packer above the original packer so that the vapor injection point is moved upward in the oil bearing formation.

4. The method of claim 3 wherein the upper packer is sequentially repositioned and to vertically separate the solvent vapor injection level and the oil removal level in the well hole.

5. The method of claim 3, wherein a portion of the recovered oil product is used as fuel to fire and heat the externally provided hydrocarbon liquid to generate solvent vapor.

* * * * *